US011022943B2

(12) United States Patent
Romano et al.

(10) Patent No.: US 11,022,943 B2
(45) Date of Patent: Jun. 1, 2021

(54) DEVICE FOR ATTACHING A BRACELET

(71) Applicant: Montres Breguet S.A., L'Abbaye (CH)

(72) Inventors: Orane Romano, Les Hauts de Bienne (FR); Fabrice Rochat, Vallorbe (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 333 days.

(21) Appl. No.: 16/141,343

(22) Filed: Sep. 25, 2018

(65) Prior Publication Data

US 2019/0121295 A1 Apr. 25, 2019

(30) Foreign Application Priority Data

Oct. 19, 2017 (EP) ..... 17197367

(51) Int. Cl.
*G04B 37/14* (2006.01)
*A44C 5/14* (2006.01)

(52) U.S. Cl.
CPC ..... *G04B 37/1486* (2013.01); *A44C 5/14* (2013.01); *G04B 37/1493* (2013.01)

(58) Field of Classification Search
CPC ..... G04B 37/1486; G04B 37/1493; G04B 37/16; A44C 5/14; A44C 5/147; A44C 5/2052; A44C 5/10
See application file for complete search history.

(56) References Cited

U.S. PATENT DOCUMENTS 3,217,374 A 11/1965 Sang
5,416,953 A * 5/1995 Hui ..... A44C 5/14 224/164
5,914,913 A * 6/1999 Shriqui ..... A44C 5/14 224/164
7,249,398 B2 * 7/2007 Roy ..... A44C 5/147 24/265 B (Continued)

FOREIGN PATENT DOCUMENTS

CH 327838 2/1958
CH 614 589 12/1979

(Continued)

OTHER PUBLICATIONS

European Search Report dated Apr. 11, 2018 in European application 17197367.0, filed on Oct. 19, 2017 (with English Translation of Categories Cited Documents).

*Primary Examiner* — Edwin A. Leon
(74) *Attorney, Agent, or Firm* — Oblon, McClelland, Maier & Neustadt, L.L.P.

(57) ABSTRACT

A device for attaching a bracelet or strap to a watch case includes a bar secured to the watch case by at least one horn and an insert integral with the end of the bracelet. The bar and the insert are complementary to cooperate by interlocking or fitting with each other to form a removable assembly to make the bracelet interchangeable. The bar is formed by a cylindrical shaft having a flat portion, the flat portion being arranged to cooperate by interlocking or fitting with at least one housing made in the insert, the housing having a (Continued)

substantially rectangular opening for receiving the flat portion. The shaft is telescopic to move from a first position, in which the insert is positionable on the shaft, to a second position, in which the insert is locked on the shaft.

10 Claims, 2 Drawing Sheets

(56) References Cited

U.S. PATENT DOCUMENTS

| | | | | |
|---|---|---|---|---|
| 8,790,004 | B2 * | 7/2014 | Chatelain ..... | G04B 37/1486<br>368/282 |
| 2013/0003510 | A1 | 1/2013 | Speichinger | |
| 2015/0320128 | A1 | 11/2015 | Yoo | |
| 2017/0172499 | A1 | 6/2017 | Yoo | |

FOREIGN PATENT DOCUMENTS

| | | | |
|---|---|---|---|
| EP | 2 540 188 | A1 | 1/2013 |
| JP | 2014-161402 | | 9/2014 |

* cited by examiner

DEVICE FOR ATTACHING A BRACELET

This application claims priority from European Patent Application No. 17197367.0 filed on Oct. 19, 2017, the entire disclosure of which is hereby incorporated herein by reference.

FIELD OF THE INVENTION

The present invention relates to the field of horology or jewelry. More specifically, it concerns a method for attaching a strap or bracelet to an object, particularly a watch case.

BACKGROUND OF THE INVENTION

Generally, straps or bracelets, made of leather or metal, are attached to the horns of a watch case by means of a bar formed of a tube, inside which are mounted two pistons that move in translation, and an elastic member disposed between said pistons and intended to drive them outwardly of the tube. Said bar is mounted inside a housing provided for this purpose at one end of the bracelet, and the pistons are engaged in blind bores facing them in the horns of the case.

To detach a strap or bracelet attached to a case in this manner, it is necessary to have a tool designed to push the pistons back inside the tube, against the stress exerted by the elastic member, and thereby remove them from the bores. The wearer of the watch does not permanently carry such a tool, and moreover, the tool can be inconvenient to use. This is why bracelets provided with such an attachment device are generally permanently secured to the case.

There are also attachment devices that allow the bracelet to be removed from the case without using a tool. Such devices usually comprise a bar, of the type described above, on which is mounted, through the tube, a member for actuating the pistons. Said actuation member is, for example, a radial finger integral with one of the pistons, as described in Swiss Patent No CH327838. The finger is slidably mounted through an axial slot made in the tube, and its movement along the slot pushes one of the pistons inside the tube.

CH Patent No. 614589 discloses a watch case with a device for attaching a strap to the case, the central horn has a cylindrical passage that is slit longitudinally over the entire length of the horn, to allow insertion of a bar for attaching a strap. The bar takes the form of a cylinder with a flat portion along its entire length to allow the bar to pass when it is inserted into the passage and to hold the bar in place when the latter occupies a determined angular position.

The attachment devices thus described are generally employed for interchangeable bracelets or straps which the user can then change as desired. They are not, however, free of drawbacks. It will be noted in particular, that they require major structural modifications to the bar, such as, for example, making an opening in the tube, or transforming the pistons. These changes entail significant extra manufacturing costs. These attachment devices also include a protruding element, namely the actuating member, which may snag or injure the wearer of the watch.

SUMMARY OF THE INVENTION

The present invention makes it possible to overcome these drawbacks by proposing a device for attaching a bracelet or strap to a watch case, the device comprising, on the one hand, a bar secured to the watch case by means of at least one horn, and on the other hand, an insert integral with the end of the bracelet, wherein the bar and the insert are complementary in order to cooperate by fitting one inside the other to form removable assembly means able to make the bracelet interchangeable.

According to the invention, the bar is formed by two cylindrical shafts having at least one flat portion, said flat portion being arranged to cooperate by interlocking or fitting with at least one housing made in said at least one insert, said at least one housing having a substantially rectangular opening for receiving said at least one flat portion, wherein each shaft is telescopic in order to move from a first position A, in which the shaft is deployed and the inset is positionable on the bar shaft, to a second position B, in which the bar is retracted and said insert is locked onto the bar shaft.

According to other advantageous variants of the invention:

- the bar includes at least one guide track extending over all or part of its length;
- said at least one track includes at least one notch, said notch being configured to define position B, called the retracted position;
- the horn includes guide means arranged to slide inside said at least one track;
- the guide means include a guide pin arranged to cooperate with said guide track;
- said guide track is L-shaped, the base of the L receiving said locking notch that defines the position B or locked position of the shaft;
- the shaft includes at least one collar at at least one end, said at least one collar forming an axial retaining element;
- said at least one collar cooperates with at least one lateral stop surface of the watch case;
- the watch case comprises a median horn including a passage whose diameter corresponds to the diameter of the bar shaft;
- the bar includes two shafts each including two parallel and symmetrical flat portions, arranged to cooperate with said housing of said insert;
- said housing takes the form of a groove with an opening, the housing having a C-shaped cross-section.

BRIEF DESCRIPTION OF THE DRAWINGS

Other features and advantages of the present invention will appear more clearly from the following detailed description of an example embodiment of a device for attaching a strap or bracelet according to the invention, this example being given solely by way of non-limiting illustration with reference to the annexed drawing, in which.

DETAILED DESCRIPTION OF PREFERRED EMBODIMENTS

FIGS. 1 to 4 illustrate a wristwatch and detailed views of the device for attaching bracelet 2 to watch case 1 according to a preferred embodiment of the invention. The device for attaching bracelet 2 to watch case 1 includes, on the one hand, a bar 4 secured to the watch case by means of at least one horn integral with the case, and on the other hand, an insert integral with the end of bracelet 2, wherein bar 4 and insert 20 are complementary and cooperate by interlocking or fitting with each other to form removable assembly means able to make the bracelet interchangeable.

Figure 2A:
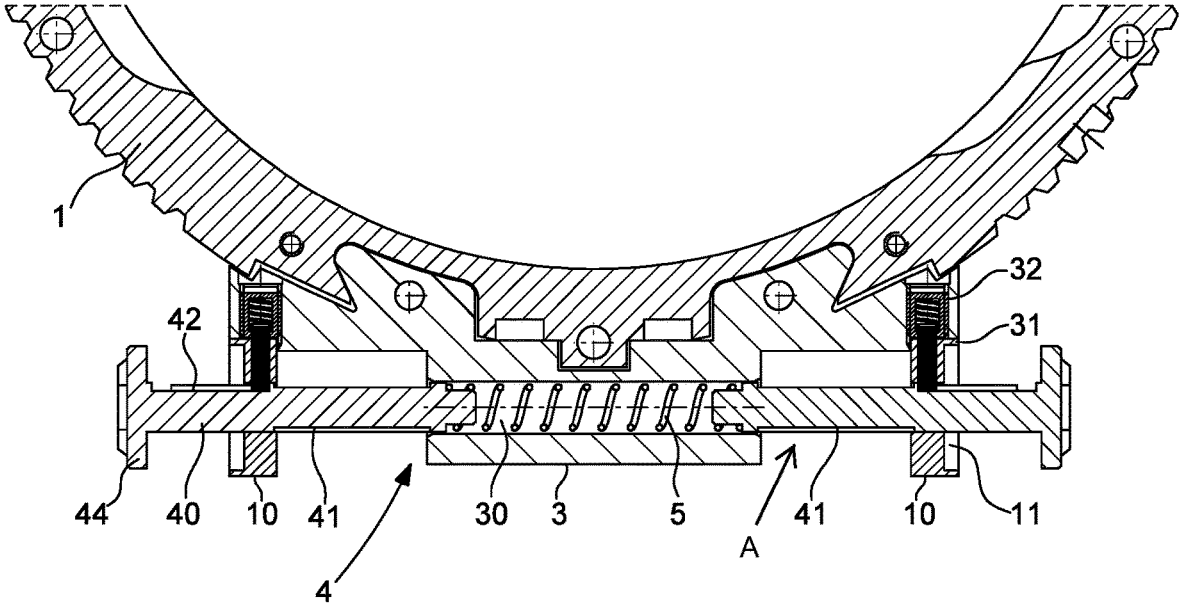
FIGS. 2*a* and 2*b* represent a transverse cross-section of the watch case with the device respectively in the deployed and retracted position.
Figure 2B:
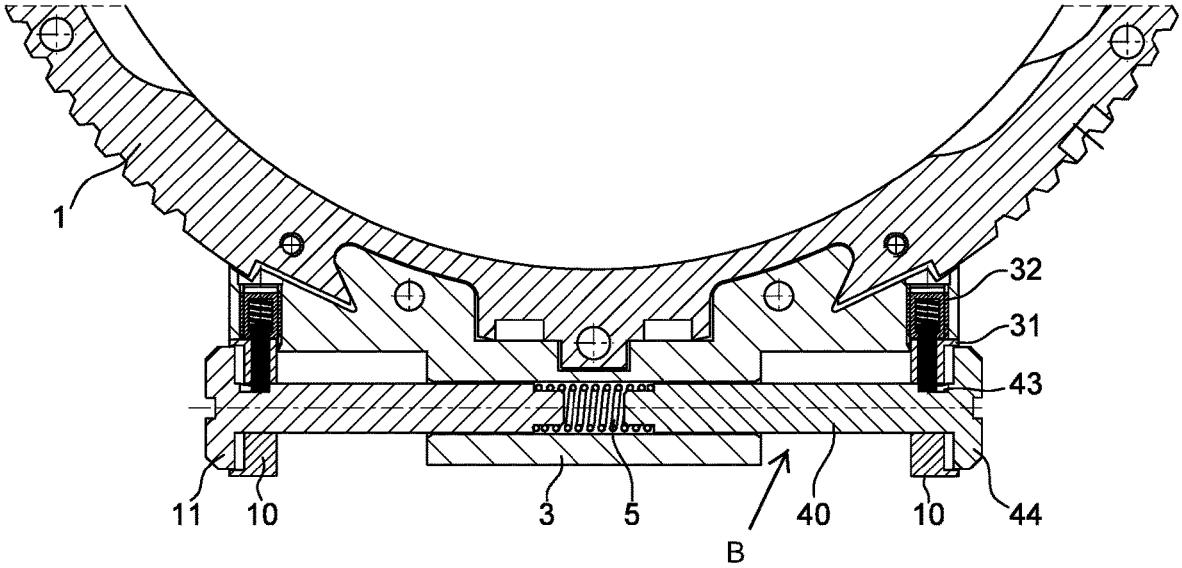

As can be observed in FIGS. 2*a* and 2*b*, the watch case includes a median horn comprising a passage 30 whose diameter corresponds to the diameter of the shaft of bar 4 such that the latter can turn freely inside the housing. Median horn 3 consists of a single piece and can be arranged to be removable and held on watch case 1 by means of screws for example. Such an arrangement makes it possible to assemble and disassemble the horn quickly and easily. It is also possible to envisage the horn being formed with the watch case.

According to the invention, bar 4 is formed by at least one cylindrical shaft 40 having at least one flat portion 41, flat portion 41 being arranged to cooperate by interlocking or fitting with at least one housing 200 made in insert 20 of bracelet portion 2 or of a link. As represented in the Figures, bar 4 is formed by two shafts 40, each including two parallel and symmetrical flat portions 41, and the two shafts 40 are separated by a spring 5 that pushes them away from each other, shafts 40 tending to be returned to the deployed position by spring 5 disposed inside housing 30 of horn 3 when the shafts are not locked.

Those skilled in the art could devise a single shaft forming bar 4 and would have no particular difficulty in adapting this device to a watch case comprising a conventional pair of horns.

Advantageously, shaft 40 is arranged to be telescopic to move from a first position A, in which the shaft is deployed and insert 20 is positionable on shaft 40, to a second position B, in which the shaft is retracted and the insert is locked on bar shaft 40.

Figure 3A:
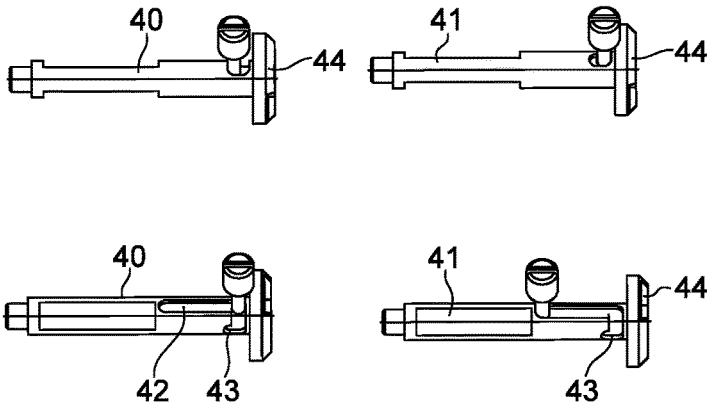
FIGS. 3*a* and 3*b* illustrate a bar of an attachment device according to the invention.
Figure 3B:
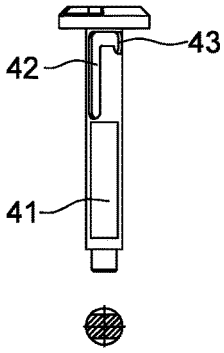

As illustrated in FIGS. 3*a* and 3*b*, shaft 40 includes at least one L-shaped or bayonet-shaped guide track 42 extending over one portion of its length, track 42 including at least one notch 43, on the base of the L, to define the retracted position of shaft 40.

Further, shaft 40 includes at least one operating member at its free end for pivoting the bar from a first position A, in which flat portion 41 of the shaft is able to receive the insert, to a second position B in which insert 20 is locked onto bar 4.

As illustrated, the operating member includes a collar 44 integral with each of the ends of shaft 40, with shaft 40 and collar 44 thus forming a single element. It is also possible to envisage assembling collar 44 to the end of shaft 40 by means of an insertion tip mounted in a hollow portion of shaft 40. An internal bump is in that case arranged at the end of shaft 40 for cooperating with the insertion tip, so as to snap collar 44 into shaft 40. Other means of fixing collars 44 can be envisaged, such as, for example adhesive bonding, welding or press fitting. These collars act as axial retaining elements for bar 4 and insert 20.

According to the invention, horn 3 includes guiding and locking means arranged to slide inside track 42 and guide shaft 40 during a change of position. These guide means, seen, in particular, in FIGS. 2*a* and 2*b*, include at least one guide pin 31 stressed by a spring 32 to limit play and to ensure proper contact of the guide pin in track 42 of shaft 40. Guide pin 31 also allows the shaft to be locked in the retracted position, as the guide pin cooperates with notch 43, on the base of the L, to keep shaft 40 in the retracted position.

Yet another advantage of such a device is that guide pin 31 can hold shaft 40 on horn 3, since the shaft cannot be dislodged while guide pin 31 is in place. Thus, there is no risk of losing shaft 40 or spring 5 when the bracelet is changed. Naturally, those skilled in the art could envisage any other type of guide means, such as a projecting lug or post for example.

Figure 4:
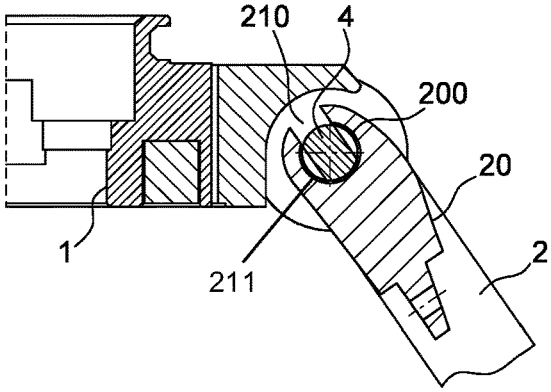
FIG. 4 illustrates a cross-sectional view of the insert attached to the watch case via the bar.

As can be seen in FIGS. 2*a*, 2*b* and 4, insert 20 includes a housing 200 with a substantially rectangular opening 210 for receiving flat portion 41 of shaft 40, with the height and length of opening 210 corresponding to the height and length of flat portions 41 of bar 4. Housing 200 is made in insert 20 of the bracelet portion. Housing 200 takes the form of an open housing formed by a cylindrical groove 210 machined in insert 20 of the bracelet portion. This cylindrical groove includes a rectangular opening 210 for the insertion and holding of cylindrical bar 40 which has two flat portions 41 to match the shape of the housing. It can thus be observed in the cross-sectional view of FIG. 4 that groove 211 has a C-shaped cross-section.

Figure 1:
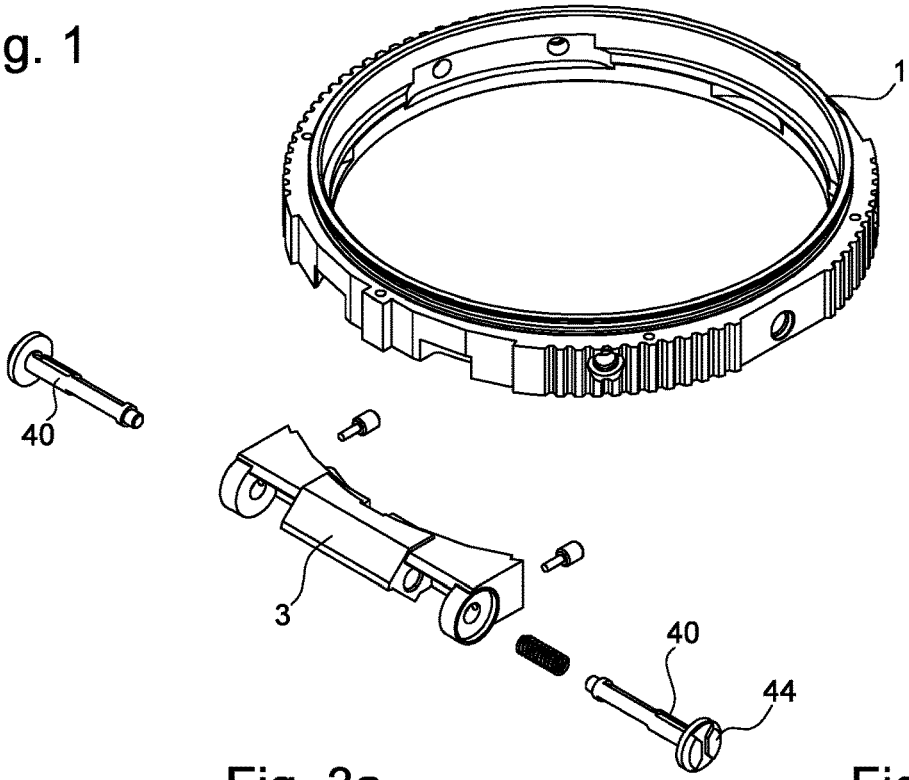
FIG. 1 illustrates an exploded perspective view of a watch case equipped with an attachment device according to the invention.

According to the preferred embodiment illustrated in FIG. 1, horn 3 has first vertical lateral walls 10, in which is arranged a cylindrical recess 11 for partially housing collars 44 therein. Collars 44 preferably have a cylindrical shape here to fit inside recesses 11.

To attach bracelet 2 to case 1 as illustrated in FIGS. 2*a* and 2*b*, pressure is applied to shaft(s) 40 until guide pin 31 abuts against the wall of guide track 42, then the shaft(s) are pivoted at an angle defined by the guide track, defined here by the length of the base of the L formed by the track, and the pressure applied on the shaft(s) is released so that spring 5 pushes back shaft(s) 40, which will then move into the deployed position. This kinematic arrangement is seen in FIG. 3*a*.

Then insert 20, which is for example the end of a bracelet portion, is placed on bar 4 by placing opening 210 of housing 200 opposite flat portions 41 of shaft(s) 40 in order to fit bar 4 inside housing 200.

Once insert 20 is in place on bar 4, the user performs the reverse operations, i.e. applies pressure on the shaft(s) until guide pin 31 abuts on the wall of guide wall 42, then pivots the shaft about axis A-A by means of the collars into position B, and releases the pressure applied so that the guide pin is placed inside locking notch 43 under the effect of spring 5. Thus, the bracelet portion can no longer be dislodged as can be observed in FIG. 2*b*.

Advantageously, at least one of collars 44 includes a slot arranged on its external face, namely the face visible to the wearer of the watch, to cooperate with a tool or the user's finger to facilitate manipulation of collar 44 and the locking and/or unlocking of insert 20 on bar 4.

Advantageously, insert 20 matches the shape of median horn 3 to limit play during assembly and to provide a high-quality assembly.

In the embodiment described above, the insert is disposed on a bracelet or strap made of leather, synthetic fabric, plastic, metal, ceramic or composite material. Likewise, bar 4 is preferably made of metal but could also be made of plastic, ceramic or composite material.

As a result of these different aspects of the invention, there is provided a secure bracelet attachment device allowing the bracelet to be quickly and easily changed.

Of course, the present invention is not limited to the illustrated example and is capable of various variants and modifications that will appear to those skilled in the art.

What is claimed is:

1. A device for attaching a bracelet or strap to a watch case, the device comprising:

a bar secured to the watch case by at least one horn, and;

an insert integral with an end of the bracelet, the bar and the insert being complementary to cooperate by interlocking or fitting with each other to form removable assembly means capable of making the bracelet interchangeable, wherein the bar is formed by at least one cylindrical shaft having at least one flat portion, said flat portion being arranged to cooperate by interlocking or fitting with at least one housing made in said at least one insert, said at least one housing having a substantially rectangular opening for receiving said at least one flat portion, said shaft being telescopic in order to move from a first position, in which the shaft is deployed and the insert is positionable on the shaft, to a second position, in which the shaft is retracted and said insert is locked on the bar shaft, wherein the bar includes at least one guide track extending along one part of a length of the bar, the at least one guide track being separate from the at least one flat portion, and the horn includes guide means arranged to slide inside said at least one guide track.

2. The attachment device according to claim 1, wherein said at least one guide track includes at least one locking notch, said locking notch being configured to define the second position of the shaft, called the retracted position.

3. The attachment device according to claim 1, wherein the guide means include a guide pin arranged to slide inside said guide track.

4. The attachment means according to claim 2, wherein said guide track is L-shaped, the base of the L receiving said locking notch defining the second position or locked position of the shaft.

5. The attachment device according to claim 1, wherein the shaft includes a collar at a free end of the shaft.

6. The attachment device according to claim 5, wherein said at least one collar cooperates with at least one lateral stop surface of the watch case.

7. The attachment device according to claim 1, wherein the horn includes a passage whose diameter corresponds to the diameter of the shaft.

8. The attachment device according to claim 1, wherein the bar includes two of the shafts each including two of the flat portions, the two flat portions being parallel, symmetrical, and arranged to cooperate with said housing of said insert.

9. The attachment device according to claim 1, wherein said housing includes a groove with an opening, the housing having a C-shaped cross-section.

10. The attachment device according to claim 1, wherein the guide means include a spring to bias the guide pin towards said guide track.

* * * * *